US007404729B2

(12) United States Patent
Hong

(10) Patent No.: US 7,404,729 B2
(45) Date of Patent: Jul. 29, 2008

(54) ELECTRIC CONNECTOR

(75) Inventor: Fan Shin Hong, Singapore (SG)

(73) Assignee: MEA Technologies Pte. Ltd., Singapore (SG)

( * ) Notice: Subject to any disclaimer, the term of this patent is extended or adjusted under 35 U.S.C. 154(b) by 0 days.

(21) Appl. No.: 11/724,114

(22) Filed: Mar. 14, 2007

(65) Prior Publication Data

US 2007/0232152 A1 Oct. 4, 2007

(30) Foreign Application Priority Data

Apr. 4, 2006 (SG) ..... 200602224-8

(51) Int. Cl.
*H01R 13/267* (2006.01)

(52) U.S. Cl. ..... 439/353

(58) Field of Classification Search ..... 439/700, 439/353, 352, 188, 310, 350, 357, 141
See application file for complete search history.

(56) References Cited

U.S. PATENT DOCUMENTS 6,250,945 B1 * 6/2001 Murakami et al. ..... 439/353
6,837,727 B2 * 1/2005 Migimatsu et al. ..... 439/247
6,896,529 B2 5/2005 Jing

* cited by examiner

*Primary Examiner*—Alexander Gilman
(74) *Attorney, Agent, or Firm*—Osha Liang LLP

(57) ABSTRACT

An electric connector includes a plug terminal 15 and a connector housing 2. The plug terminal 15 has a contact portion $\mathbf{15}_1$ in one end and an electric wire connecting terminal $\mathbf{15}_3$ in the other end, and the connector housing 2 accommodating the plug terminal. In the plug terminal 15, the contact portion and the electric wire connecting portion are connected through an elastic spring portion 15*b*, the connector housing 2 accommodates both the plug terminal 15 and a gate member 10 which holds a contact portion of the plug terminal, the contact portion $\mathbf{15}_1$ of the plug terminal is held in the connector housing by the gate member 10 while the spring is compressed and pushed in, and the hold state is released to project the contact portion of the plug terminal from the connector housing in coupling the electric connector to the mating connector. Therefore, the invention can provide the electric connector enabling it to protect the plug terminal with a simple structure in which the contact portion of the plug terminal is pushed in the connector housing before coupling the electric connector to the mating connector.

12 Claims, 13 Drawing Sheets

Fig.1
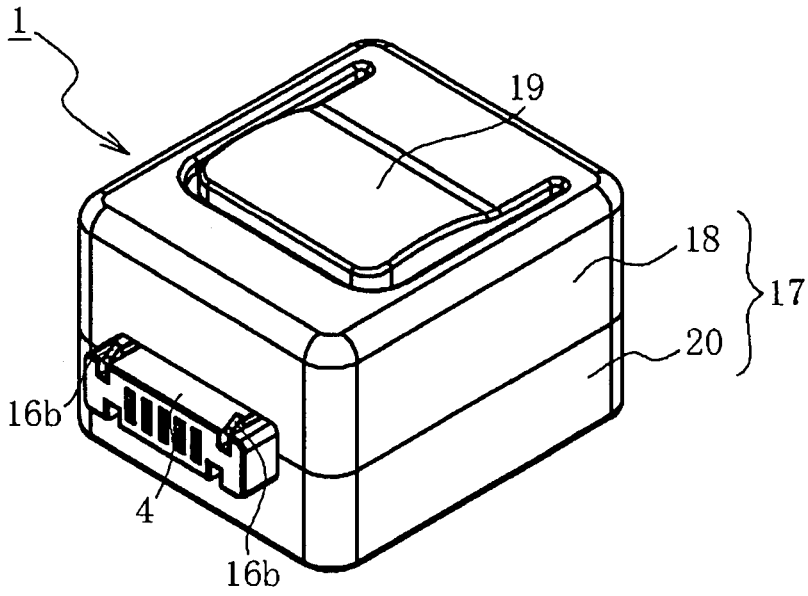
Fig. 1A
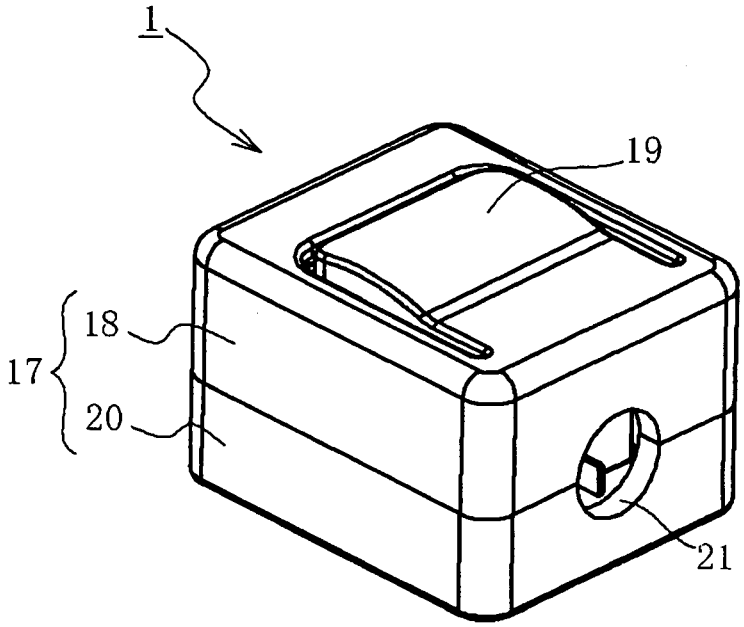
Fig. 1B

Fig.3
Fig. 3A
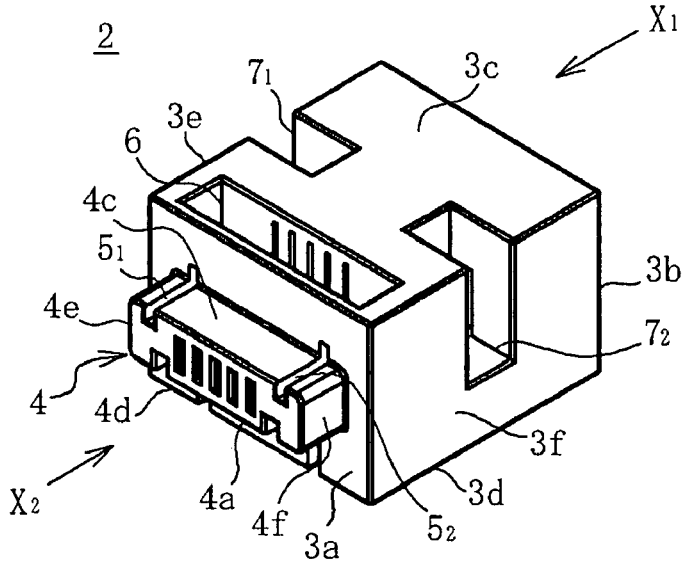
Fig. 3B
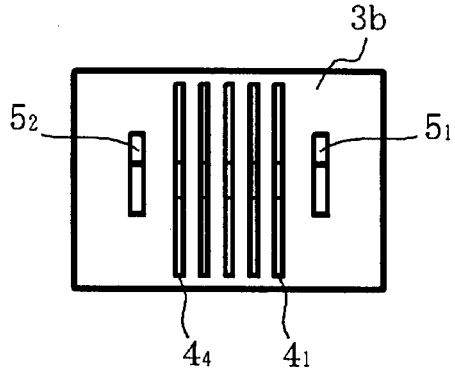
Fig. 3C
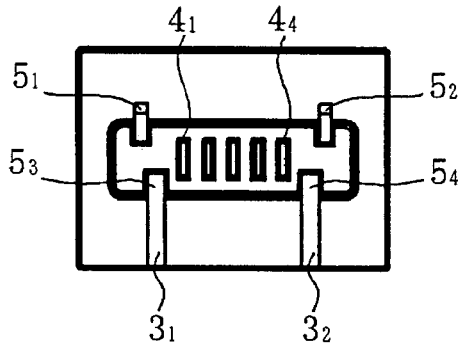

Fig.4
Fig. 4A
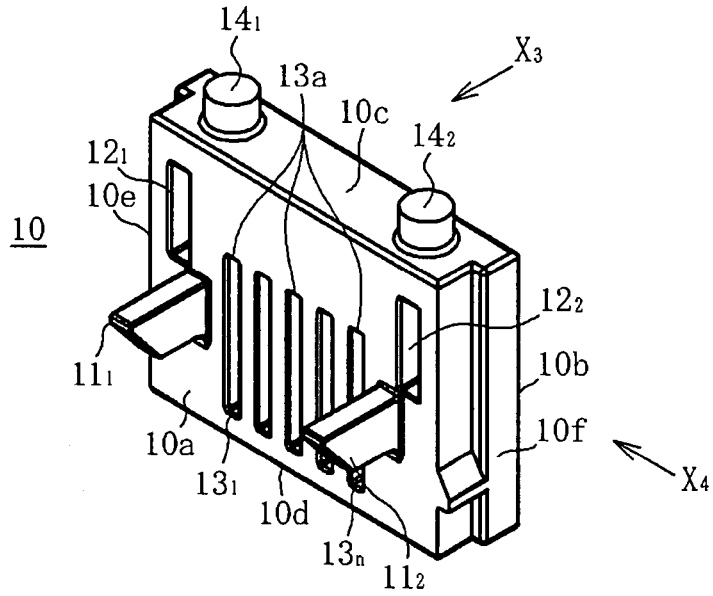
Fig. 4B
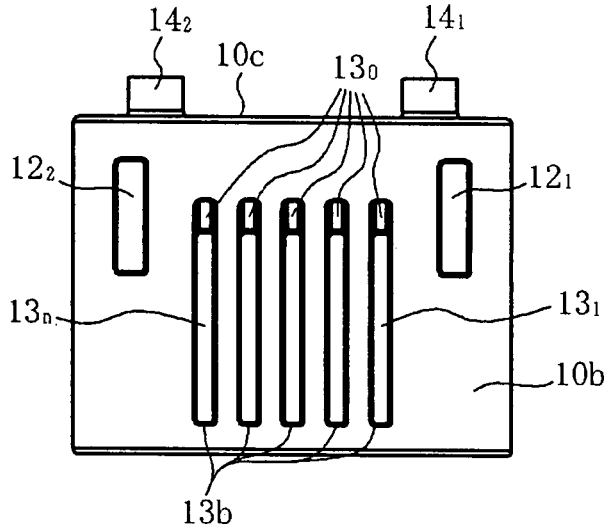
Fig. 4C
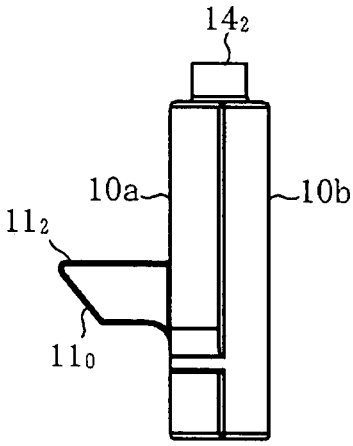

Fig.5
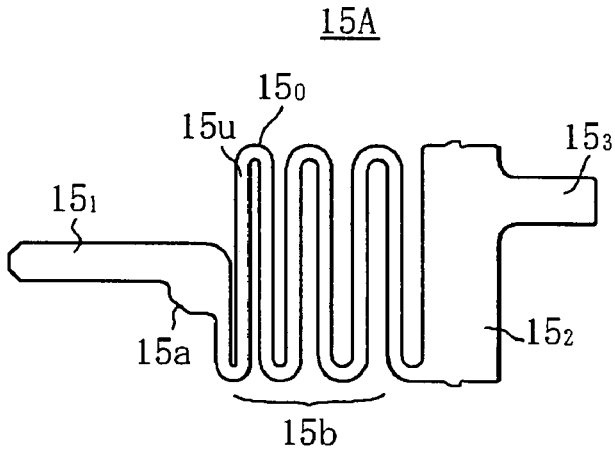
Fig. 5A
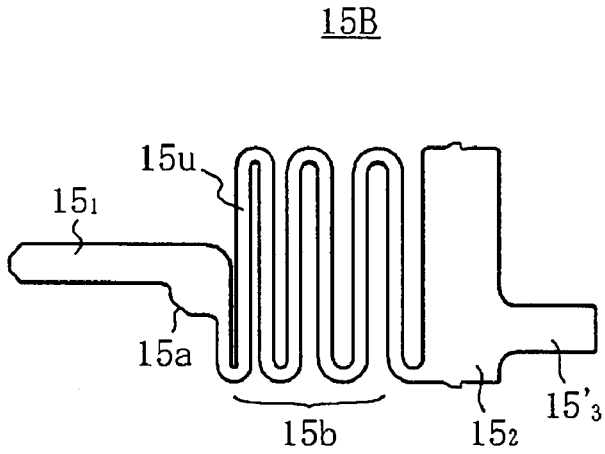
Fig. 5B

Fig.7
Fig. 7A
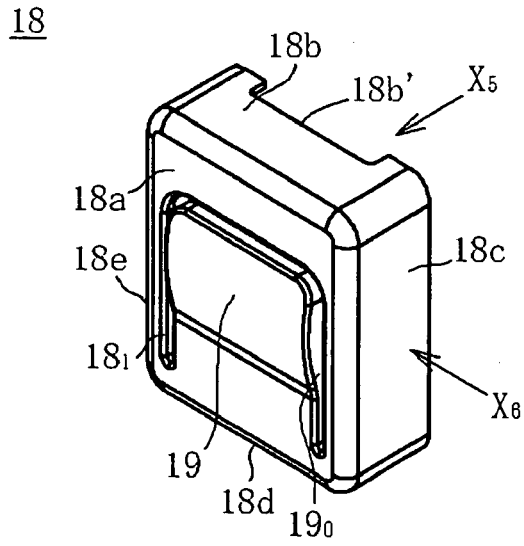
Fig. 7B
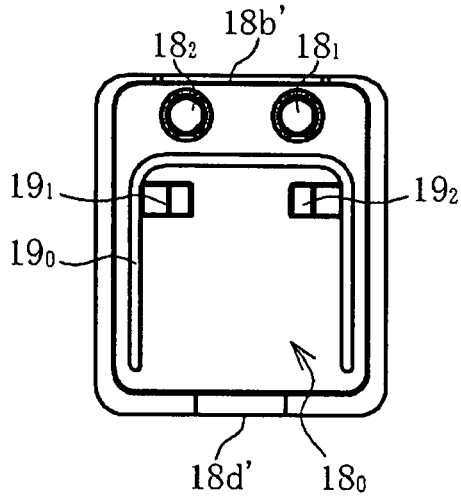
Fig. 7C
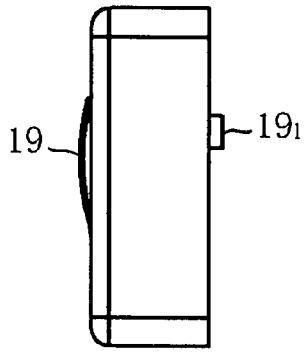

Fig.8
Fig. 8A
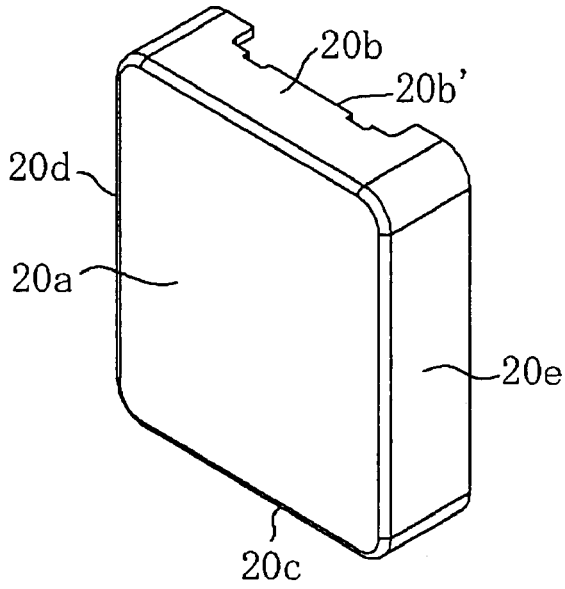
Fig. 8B
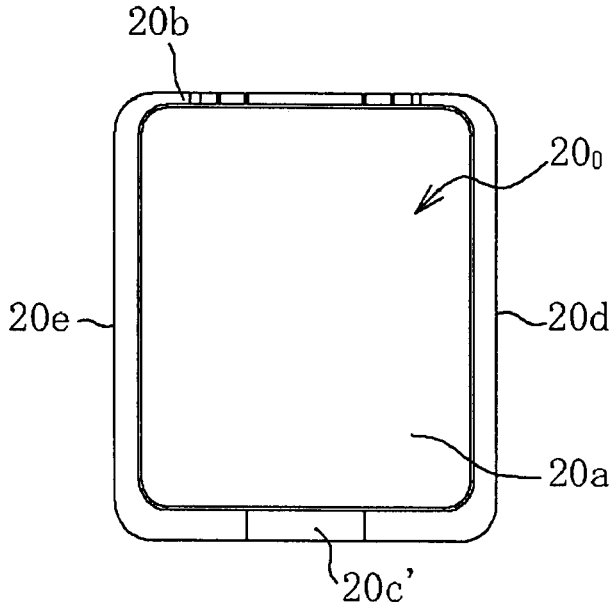

Fig.10
Fig. 10A
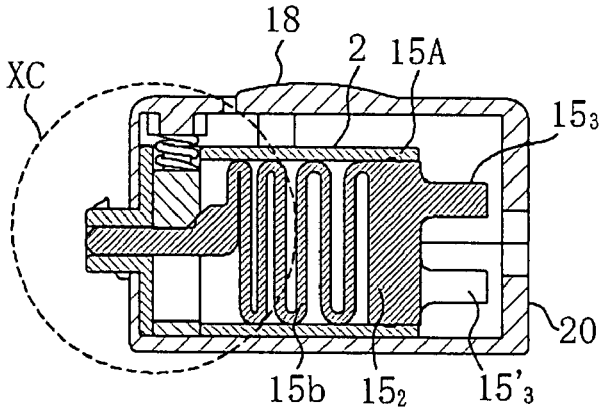
Fig. 10B
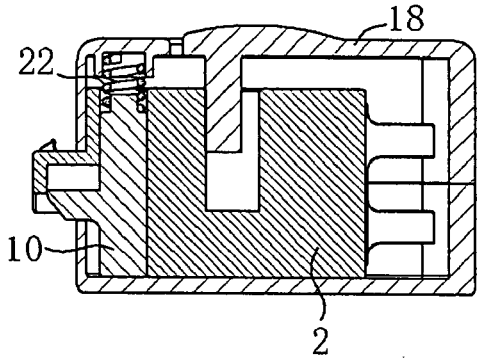
Fig. 10C
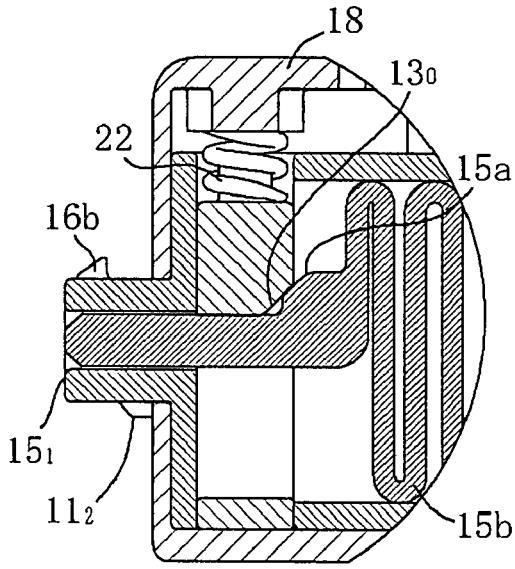

Fig.11
Fig. 11A
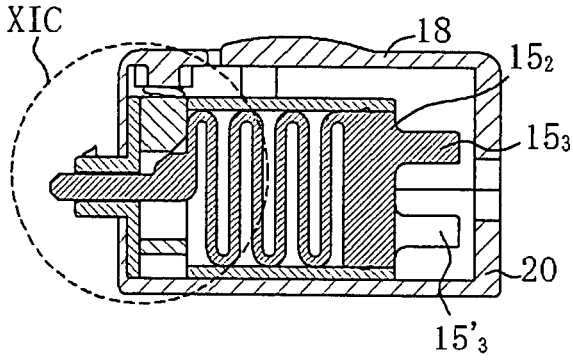
Fig. 11B
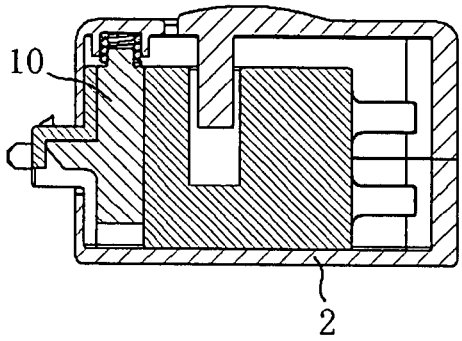
Fig. 11C
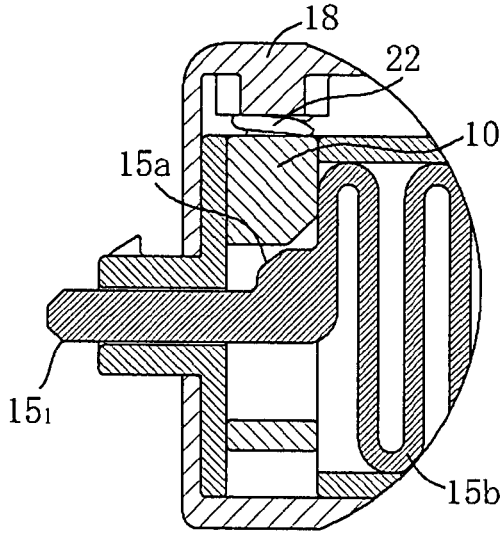

ELECTRIC CONNECTOR

BACKGROUND OF THE INVENTION

1. Field of the Invention

The present invention relates to a plug-type electric connector coupled to a receptacle connector.

2. Description of the Related Art

An electric connector is used in almost all of electric or electronic instruments. The electric connector usually includes a receptacle connector and a plug-type connector which is plugged in the receptacle connector. For example, as shown in FIG. 12, a plug-type electric connector 30 disclosed in U.S. Pat. No. 6,896,529B2 includes three plug terminals 31*a* to 31*c*, a connector housing (hereinafter simply referred to as "housing") 32, and a cover body 33. The housing 32 accommodates the plug terminals, and the housing 32 is covered with the cover body 33. The housing 32 and the cover body 33 are made of insulating materials.

The housing 32 includes a rectangular solid-shaped body 32*a* and a U-shaped heads 32*b* extending from the body 32*a*. Three plug terminals 31*a* to 31*c* are projected with the same length within the U-shaped head 32*b*. Opposite portions of the U-shaped head 32*b* include a pair of side pieces $\mathbf{32}_1$ and $\mathbf{32}_2$, and thin grooves are formed in the side pieces $\mathbf{32}_1$, $\mathbf{32}_2$ respectively, and lock arms $\mathbf{34}_1$, $\mathbf{34}_2$ to be engaged with a mating connector (not shown) are accommodated in the grooves. In the three plug terminals 31*a* to 31*c*, their front end portion is located in the U-shaped head 32*b*, and their rear end portion is accommodated in the housing 32 while projecting into the end portion of the body 32*a*. Electric wire is connected to the rear end portion of each of the plug terminals 31*a* to 31*c*. The housing 32 accommodates the plug terminals 31*a* to 31*c* and the lock arms $\mathbf{34}_1$ and $\mathbf{34}_2$, and then the cylindrical cover body 33 is fitted in the body 32*a* of the housing 32. A push button 33*a* is formed in one of surfaces of the cover body 33, the lock arms $\mathbf{34}_1$ and $\mathbf{34}_2$ are lowered to release the engagement with the mating connector by depressing the push button 33*a*.

In the electric connector 30, the respective plug terminals 31*a* to 31*c* are projected from the U-shaped head 32*b* of the housing 32. There is also well known an electric connector which plug terminals are accommodated in a housing before coupling to a mating connector. As shown in FIG. 13, this kind of typical electric connector 35 includes a terminal portion 38, a housing 39, and a cover body 40 covering the housing 39. The terminal portion 38 has a coil spring 36 and a plug terminal 37, and the housing 39 accommodates the terminal portion 38. In coupling the electric connector 35 to the mating connector M, the cover body 40 of the connector 30 is pressed against the mating connector M to move the cover body 40 in a Y-direction. The plug terminal 37 is projected from the cover body 40 and brought into contact with a contact C by moving the cover body 40 in the Y-direction. In the electric connector 35, the plug terminal 37 is accommodated in the housing 39 before coupling with the mating connector M, so that the plug terminal 37 never collides with an obstacle.

In the electric connector 30 disclosed in U.S. Pat. No. 6,896,529 B2, the three plug terminals 31*a* to 31*c* are positioned within the U-shaped side pieces $\mathbf{32}_1$ and $\mathbf{32}_2$ of the U-shaped head 32*b*, and the three plug terminals 31*a* to 31*c* are coupled to the mating connector. Before coupling the three plug terminals 31*a* to 31*c* to the mating connector, the three plug terminals 31*a* to 31*c* are always projected outward although they are located within the U-shaped side pieces. Therefore, the obstacle or the like comes into contact with the projected plug terminal to damage or deform the plug terminal, and the plug terminal might be folded down at worst. Any damage, deformation or the like of the plug terminal causes a failure of connection to the mating connector in good condition. On the contrary, in the conventional electric connector 35, because the plug terminal 37 is covered with the cover body 40, such problems are never caused. However, in the terminal portion 38 of the electric connector 35, because the plug terminal 37 and the spring 36 are individually formed, the number of component items is increased while an assembling work becomes complicated, and it is difficult to stably maintain electric contact between the plug terminal 37 and the spring 36. Further, because the cover body 40 is moved in coupling the electric connector 35 to the mating connector M, a mechanism for moving the cover body 40 is required to complicate the structure of the electric connector 35.

In view of the foregoing, an object of the invention is to provide an electric connector enabling it to protect the plug terminal with a simple structure in which the contact portion of the plug terminal is pushed into the connector housing before the electric connector is coupled to the mating connector.

Another object of the invention is to provide an electric connector which can easily be assembled with the small number of component items by making the plug terminal integrated with the contact portion and the spring usable.

SUMMARY

In order to achieve the above objects, a first aspect of the invention is an electric connector which includes a plug terminal and a connector housing, the plug terminal having a contact portion in one end and an electric wire connecting portion in the other end, the connector housing accommodating the plug terminal, the electric connector is characterized in that, in the plug terminal, the contact portion and the electric wire connecting portion are connected to each other through an elastic spring, the connector housing accommodates both the plug terminal and a gate member which holds a contact portion of the plug terminal, the contact portion of the plug terminal is held in the connector housing by the gate member while the spring is compressed and pushed in, and the hold state is released to project the contact portion of the plug terminal from the connector housing in coupling the electric connector to the mating connector.

In the electric connector according to the first aspect, a second aspect of the invention is characterized in that the spring of the plug terminal is formed by connecting plural laterally-facing S-shaped spring units in the same plane, and the laterally-facing S-shaped spring units are elastically expanded and contracted in a longitudinal axis direction of the plug terminal.

In the electric connector according to the second aspect, a third aspect of the invention is characterized in that the contact portion is formed in one end portion of the spring including the coupled laterally-facing S-shaped spring units such that the contact portion is projected toward the longitudinal axis direction of the plug terminal, a fixing portion is formed in the other end portion in order to fix the spring to the connector housing, and the electric wire connecting portion is formed in the fixing portion.

In the electric connector according to the third aspect, a fourth aspect of the invention is characterized in that the plug terminal includes two types of first and second plug terminals, electric wire connecting portions of the first and second plug terminals are formed at positions where the fixing portions differ from each other, and the first and second plug terminals are alternately fitted in the connector housing.

In the electric connector according to the first aspect, a fifth aspect of the invention is characterized in that the gate member includes holding means and an operating member, the holding means accommodating and holding at least a part of the contact portion of the plug terminal, the operating member releasing the hold of the contact portion by the holding means in coupling the electric connector to the mating connector, and the gate member is movably accommodated in the connector housing.

In the electric connector according to the first aspect, a sixth aspect of the invention is characterized in that, in the connector housing, a projection portion projected forward from a coupling face between the electric connector and the mating connector is formed, and an operating member is inserted into a groove provided in the projection portion, the operating member moving the contact portion of the plug terminal and the gate member.

In the electric connector according to the first aspect, a seventh aspect of the invention is characterized in that the connector housing accommodates a lock member which locks the coupling between the electric connector and the mating connector.

In the electric connector according to any one of the first to seventh aspects, an eighth aspect of the invention is characterized in that the connector housing accommodates the spring which biases the gate member, and the connector housing is covered with a cover body.

In the electric connector according to the eighth aspect, a ninth aspect of the invention is characterized in that operating means is provided in the cover body, and the lock member is operated to release a lock on the mating connector by the operating means.

The invention has the above configurations to exert the following excellent effects. According to the first aspect of the invention, in the plug terminal, before coupling the electric connector to the mating connector, the contact portion is held and pushed in the connector housing by the gate member while the spring is compressed. Therefore, unlike the related art, the contact portion can be protected with the simple structure while the cover body is not moved. Because the spring is integrally provided in the plug terminal, the number of component items is not increased, there is no possibility that the contact failure is caused between the contact portion and the spring like the related art, and the contact portion and the spring are easily assembled into the connector housing.

According to the second aspect of the invention, the spring of the plug terminal is formed by connecting the plural laterally-facing S-shaped spring units, and the laterally-facing S-shaped spring units are elastically expanded and contracted in the longitudinal axis direction of the plug terminal, so that the good spring force can be obtained.

According to the third aspect of the invention, the contact portion is provided at one end of the connected laterally-facing S-shaped spring units, and the fixing portion and the electric wire connecting portion are provided at the other end. Therefore, unlike the related art, the contact portion and the spring can be integrated. The plug terminal can easily be produced by blanking the electroconductive metal plate.

According to the fourth aspect of the invention, the two types of first and second plug terminals can simply be produced by changing the forming positions of the electric wire connecting portions to the fixing portion. When the first and second plug terminals are alternately fitted in the connector housing, the positions of the electric wire connecting portions provided in the first and second plug terminals do not overlap each other in the adjacent plug terminals, and the gap between the electric wire connecting portions is broadened. Therefore, the connection with the electric wire becomes easy and the short circuit trouble between the terminals can be decreased.

According to the fifth aspect of the invention, the gate member can include the holding means for accommodating and holding the contact portion of the plug terminal and the operating member which releases the hold of the holding means in fitting and coupling the electric connector to the mating connector. Therefore, the gate member by which the projection and accommodation of the plug terminal are operated with a simple structure can be formed.

According to the sixth aspect of the invention, the fitting and the coupling are firmly performed between the electric connector and the mating connector. The contact of contact portion of the plug terminal and the operation of the operating member of the gate member can be stably performed.

According to the seventh and eighth aspects of the invention, in coupling the electric connector to the mating connector, the coupling can be locked by providing the lock member in the connector housing. The connector housing is covered with the cover body, and the housing and the cover body are individually formed. Therefore, the shape of the housing is not complicated, and the assembly in which the spring is fitted is simplified.

According to the ninth aspect of the invention, the lock can easily be released between the electric connector and the mating connector by providing the operating means in the cover body.

BRIEF DESCRIPTION OF THE DRAWINGS

FIG. 1 shows an electric connector according to a first embodiment of the invention, FIG. 1A is an appearance perspective view when viewed from one direction, and FIG. 1B is an appearance perspective view when viewed from the other direction;

FIG. 3 shows a connector housing of the electric connector of FIG. 1, FIG. 3A is an appearance perspective view, FIG. 3B is a rear view when viewed from an $X_1$ direction of FIG. 3A, and FIG. 3C is a front view when viewed from an $X_2$ direction of FIG. 3A;

FIG. 4 shows a gate member of the electric connector of FIG. 1, FIG. 4A is an appearance perspective view, FIG. 4B is a rear view when viewed from an $X_3$ direction of FIG. 4A, and FIG. 4C is a side view when viewed from an $X_4$ direction of FIG. 4A;

FIG. 5 shows a plug terminal of the electric connector of FIG. 1, FIG. 5A is a side view showing one type of plug terminal, and FIG. 5B is a side view showing another type of plug terminal;

FIG. 7 shows a lid cover of the electric connector of FIG. 1, FIG. 7A is an appearance perspective view, FIG. 7B is a rear view when viewed from an $X_5$ direction of FIG. 7A, and FIG. 7C is a side view when viewed from an $X_6$ direction of FIG. 7A;

FIG. 8 shows a base case of the electric connector of FIG. 1, FIG. 8A is an appearance perspective view, and FIG. 8B is a rear view;

FIG. 9A is a front view showing the electric connector in a state in which a contact portion of the plug terminal is pushed in a housing, FIG. 9B is a side view showing the electric connector of FIG.

9A, FIG. 9C is a front view showing the electric connector in a state in which the contact portion of the plug terminal is protruded from the housing, and FIG. 9D is a side view showing the electric connector of FIG. 9C;

FIG. 10 shows each section of the electric connector of FIG. 9, FIG. 10A is a sectional view taken on line XA-XA of FIG. 9A, FIG. 10B is a sectional view taken on line XB-XB of FIG. 9A, and FIG. 10C is an enlarged sectional view of an XC portion of FIG. 10A;

FIG. 11 shows each section of the electric connector of FIG. 9, FIG. 11A is a sectional view taken on line XIA-XIA of FIG. 9C, FIG. 11B is a sectional view taken on line XIB-XIB of FIG. 9C, and FIG. 11C is an enlarged sectional view of an XIC portion of FIG. 11A;

DETAILED DESCRIPTION OF THE PREFERRED EMBODIMENTS

A preferred embodiment of the invention will be described below with reference to the drawings. However, the preferred embodiment is illustrated by way of example of an electric connector in order to substantiate the technical thought of the invention, the invention is not intended to be limited to the electric connector of the preferred embodiment, and the invention can equally be applied to other embodiments included in claims of the invention.

First Embodiment

Figure 2:
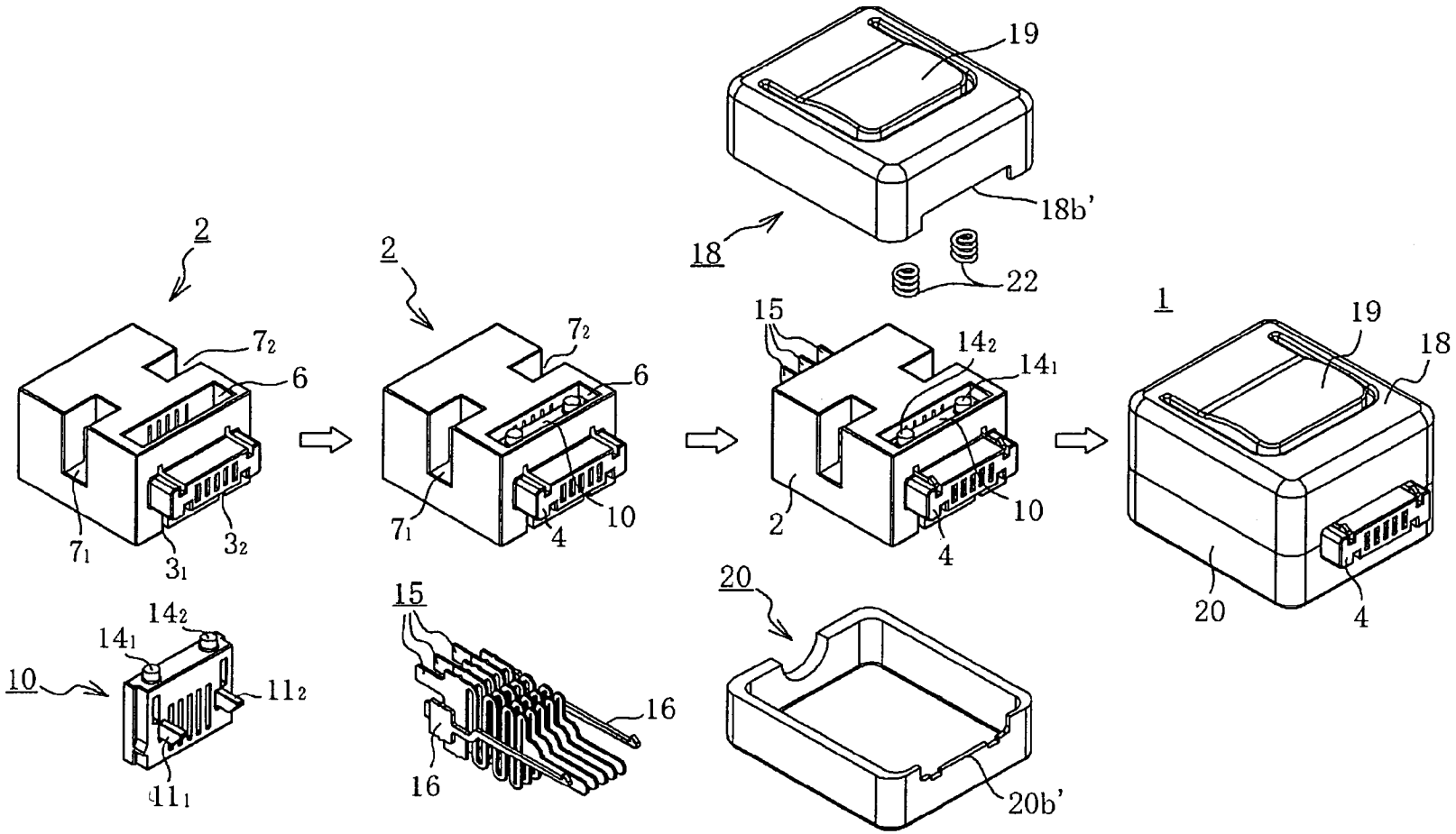
FIG. 2 is an appearance perspective view showing a process of assembling the electric connector of FIG. 1.
Figure 6:
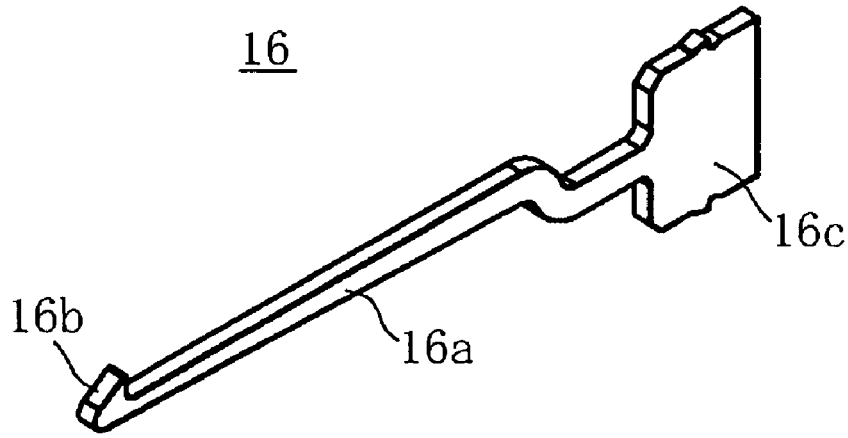
FIG. 6 is an appearance perspective view showing a lock arm of the electric connector of FIG. 1.

FIG. 1 shows an electric connector according to a first embodiment of the invention, FIG. 1A is an appearance perspective view when viewed from one direction, and FIG. 1B is an appearance perspective view when viewed from the other direction. FIG. 2 is an appearance perspective view showing a process of assembling the electric connector of FIG. 1. FIG. 3 shows a connector housing of the electric connector of FIG. 1, FIG. 3A is an appearance perspective view, FIG. 3B is a rear view when viewed from an $X_1$ direction of FIG. 3A, and FIG. 3C is a front view when viewed from an $X_2$ direction of FIG. 3A. FIG. 4 shows a gate member of the electric connector of FIG. 1, FIG. 4A is an appearance perspective view, FIG. 4B is a rear view when viewed from an $X_3$ direction of FIG. 4A, and FIG. 4C is a side view when viewed from an $X_4$ direction of FIG. 4A. FIG. 5 shows a plug terminal of the electric connector of FIG. 1, FIG. 5A is a side view showing one type of plug terminal, and FIG. 5B is a side view showing another type of plug terminal. FIG. 6 is an appearance perspective view showing a lock arm of the electric connector of FIG. 1. FIG. 7 shows a lid cover of the electric connector of FIG. 1, FIG. 7A is an appearance perspective view, FIG. 7B is a rear view when viewed from an $X_5$ direction of FIG. 7A, and FIG. 7C is a side view when viewed from an $X_6$ direction of FIG. 7A. FIG. 8 shows a base case of the electric connector of FIG. 1, FIG. 8A is an appearance perspective view, and FIG. 8B is a rear view.

An electric connector 1 of the first embodiment is a plug-type electric connector coupled to a receptacle connector. As shown in FIGS. 1 and 2, the electric connector 1 includes plural plug terminals 15 (see FIG. 5), a connector housing (hereinafter simply referred to as "housing") 2, and a cover body 17. The plug terminal 15 has a contact portion in one end and an electric wire connecting portion in the other end. The connector housing 2 accommodates the plug terminals 15 and a gate member 1 which holds the plug terminals 15. The housing 2 is covered with the cover body 17. Then, individual components constituting the electric connector 1 will sequentially be described.

As shown in FIG. 3, the housing 2 has a substantially rectangular solid shape as a whole. The housing 2 includes front and rear wall surfaces 3*a* and 3*b*, upper and lower wall surfaces 3*c* and 3*d*, and side wall surfaces 3*e* and 3*f*. The housing 2 is formed by a molding body made of a synthetic resin. The housing 2 has a projection portion 4, an accommodation hole 6, and guide grooves $7_1$ and $7_2$. The projection portion 4 is located in the front wall surface 3*a*, and the projection portion 4 is plugged in a hollow portion (not shown) of mating connector. The accommodation hole 6 pierces through the upper and lower wall surfaces 3*c* and 3*d* at a position close to the front wall surface 3*a*, and the accommodation hole 6 accommodates the gate member 10. The guide grooves $7_1$ and $7_2$ are located in the substantial center portion of both side wall surfaces 3*e* and 3*f*, and an operating piece provided in the cover body 17 is inserted into the guide grooves $7_1$ and $7_2$. In assembling the electric connector 1, the plural plug terminals 15 are accommodated in the housing 2, the contact portion of the plug terminal 15 is pushed in the projection portion 4, and an electric wire connecting terminal is projected from the rear wall surface 3*b*.

The projection portion 4 of the front wall surface 3*a* is a portion which is inserted into the hollow portion to be fitted and coupled in the mating connector (not shown). The projection portion 4 is formed in the rectangular solid shape according to the shape of the hollow portion. The projection portion 4 includes a front wall surface 4*a*, upper and lower wall surfaces 4*c* and 4*d*, and side wall surfaces 4*e* and 4*f*. The projection portion 4 is integrated with the front wall surface 3*a* of the housing 2. Fitting holes $5_1$ and $5_2$ are made on both sides of the upper wall surface 4*c* of the projection portion 4, and into which lock arms 16 (see FIG. 6) are fitted. The fitting holes $5_1$ and $5_2$ are formed according to the shape of the lock arms 16 while piercing from the projection portion 4 and the front wall surface 3*a* to the rear wall surface 3*b*. Guide grooves $3_1$ and $3_2$ are formed in the front wall surface 3*a* of the housing 2, and the guide grooves $3_1$ and $3_2$ are communicated with the lower wall surface 3*d*.

Guide grooves $5_3$ and $5_4$ are formed on the both side of the lower wall surface 4*d* of the projection portion 4, and into which arm pieces $11_1$ and $11_2$ of the gate member 10 are inserted. The guide grooves $5_3$ and $5_4$ are communicated with the guide grooves $3_3$ and $3_4$ provided in the front wall surface 3*a* of the housing 2. Plural projection-portion holes $4_1$ to $4_3$ from which the contact portions of the plug terminals 15 are projected are made at substantially equal intervals in the front wall surface 4*a* of the projection portion 4. The projection-portion holes $4_1$ to $4_n$ pierce through the housing 2 from the front wall surface 4*a* of the projection portion 4 and the front wall surface 3*a* of the housing 2 to reach the rear wall surface 3*b* of the housing 2. The groove shapes of the projection-portion holes $4_1$ to $4_n$ are formed according to the shapes of the later-mentioned plug terminals 15 (see FIG. 15) such that the plug terminals 15 can be inserted from the rear wall surface 3*b*.

As shown in FIG. 4, the gate member 10 is formed by a rectangular plate body. The gate member 10 includes front and rear wall surfaces 10*a* and 10*b*, upper and lower wall surfaces 10*c* and 10*d*, and side wall surfaces 10*e* and 10*f*. The gate member 10 is formed by a molding body made of a synthetic resin, and the molding body has a size inserted into the accommodation hole 6 of the housing 2. The front wall surface 10*a* of the gate member 10 has a pair of arm pieces $11_1$ and $11_2$, a pair of communication holes $12_1$ and $12_2$, and plural guide grooves $13_1$ to $13_n$. The arm pieces $11_1$ and $11_2$ are located near both side portions of the front wall surface, and projected forward by a predetermined length. The communication holes $12_1$ and $12_2$ are provided at positions close to the arm pieces $11_1$ and $11_2$ to guide upward and downward movements of the lock arms 16. The guide grooves $13_1$ to $13_n$ guide the upward and downward movements of the contact portions of the plug terminals 15 which are provided between the arm pieces $11_1$ and $11_2$ and between the communication holes $12_1$ and $12_2$. The respective arm pieces $11_1$ and $11_2$ are an operating member which abuts on an operating piece of the mating connector (not shown) to be lifted upward. An inclined portion $11_0$ is formed at a front end portion of each of the arm pieces $11_1$ and $11_2$ while inclined toward a lower light direction in FIG. 4C such that the gate member 10 is smoothly lifted upward when the arm pieces $11_1$ and $11_2$ abuts on the operating piece of the mating connector.

The guide grooves $13_1$ to $13_n$ of the gate member 10 pierce from the front wall surface 10*a* to the rear wall surface 10*b* respectively, and inclined portions $13_0$ are formed in the guide grooves $13_1$ to $13_n$ while groove widths in a longitudinal direction in the rear wall surface 10*b* are made longer than those in the longitudinal direction in the front wall surface 10*a*. The inclined portion $13_0$ is a shoulder portion by which a locking protrusion 15*a* of the plug terminal 15 is locked (see FIG. 10C). Small protrusions $14_1$ and $14_2$ protruded upward are formed on both sides in the upper wall surface 10*c*, and a coil spring 22 is fitted in each of the small protrusions $14_1$ and $14_2$.

As shown in FIG. 5, the plug terminal 15 includes two types of plug terminals 15A and 15B in which fitting positions of the electric wire connecting terminals differs from each other. As shown in FIG. 5A, the plug terminal 15A includes a contact portion $15_1$, a spring portion 15*b*, a fixing portion $15_2$, and an electric wire connecting terminal $15_3$. The contact portion $15_1$ includes a projection piece which is brought into contact with the contact of the mating connector. The spring portion 15*b* is connected to the contact portion $15_1$. The fixing portion $15_2$ is connected to an end portion of the spring portion 15*b*. The electric wire connecting terminal $15_3$ is provided in the fixing portion $15_2$. The plug terminal 15 is formed by performing necessary press working and the like after a metal plate having a predetermined thickness is blanked out.

In the spring portion 15*b*, plural spring units 15*u* formed in substantially laterally-facing S-shapes are connected in the same plane, a spring wire constituting each spring unit 15*u* is formed in a meandering shape, and the meandering spring wire is elastically expanded and contracted in an axial direction. That is, the spring portion 15*b* is elastically expanded and contracted in the longitudinal direction of the plug terminal 15A by deforming the spring portion 15*b* on a support point of an arc-shaped bent portion $15_0$ of the laterally-facing S-shaped spring unit 15*u*. Therefore, the meandering spring portion 15*b* is compressed to impart springiness by pressing the contact portion $15_1$ toward the direction of the fixing portion $15_2$. The contact portion $15_1$ is projected toward the substantially horizontal direction from the substantial center portion of the spring unit 15*u* located on one end of the spring portion 15*b*. A locking protrusion 15*a* is formed in a connection portion between the contact portion $15_1$ and the spring unit 15*u*, and the locking protrusion 15*a* is locked on the inclined portions $13_0$ in the guide grooves $13_1$ to $13_n$ of the gate member 10. The fixing portion $15_2$ is a portion which is fixed to the housing 2, and the fixing portion $15_2$ is formed in wide width within the housing 2. The plug terminal 15A is firmly fixed to the housing 2 by forming the fixing portion $15_2$ in wide width.

As shown in FIG. 5B, although the plug terminal 15B has the substantially same shape as the plug terminal 15A described above, the plug terminal 15B differs from the plug terminal 15A only in the position where the electric wire connecting terminal is attached to the fixing portion $15_2$. That is, the electric wire connecting terminal $15_3$ of the plug terminal 15A is provided in the upper portion of the fixing portion $15_2$, while an electric wire connecting terminal $15'_3$ of the plug terminal 15B is provided in the lower portion of the fixing portion $15_2$. The plug terminals 15A and 15B are fitted into the housing 2 while alternately arranged. The electric wire connecting terminals $15_3$ and $15'_3$ are located on the upper and lower sides by alternately arranging the electric wire connecting terminals $15_3$ and $15'_3$, so that a short circuit trouble between the adjacent plug terminals 15 can be decreased while an interval between the connected electric wires can be broadened to facilitate the connecting work.

As shown in FIG. 6, the lock arm 16 having predetermined width and length is formed in a linear shape, and integrally made of a metal material. The lock arm 16 includes a locking protrusion 16*b*, a fixing portion 16*c*, and a coupling portion 16*a*. The locking protrusion 16*b* is located at the front end of the lock arm 16, and the locking protrusion 16*b* is locked on the mating connector. The fixing portion 16*c* is located at the rear end of the lock arm 16, and is fixed to the housing 2. The coupling portion 16*a* couples the locking protrusion 16*b* and the fixing portion 16*c*. The fixing portion 16*c* of the lock arm 16 is fixed to the housing 2 such that the coupling portion 16*a* can elastically be deformed. In coupling the lock arm 16 to the mating connector, because the lock arm 16 is fixed to the housing 2, the locking protrusion 16*b* is engaged with the mating connector by elastic deformation of the lock arm 16, while operating protrusion pieces $19_1$ and $19_2$ provided in the cover body 17 are caused to lower and abut on the coupling portion 16*a* to release the engagement of the locking protrusion 16*a*.

As shown in FIG. 1, the cover body 17 includes a base case 20 and a lid cover 18. An opening of the base case 20 is covered with the lid cover 18, and the lid cover 18 is combined with and joined to the base case 20. In the cover body 17, as shown in FIG. 7, the lid cover 18 includes an upper plate 18*a*, outer peripheral walls 18*b* to 18*e*, and an opening $18_0$ which is located in the lower portion. The lid cover 18 is formed by a box-shaped container having a size in which a substantially upper-half of the housing 2 can be accommodated. The lid cover 18 is made of an insulating synthetic resin. In the upper plate 18*a*, a U-shaped cutout groove $19_0$ is formed near an outer periphery, and a push piece, i.e., a push button 19 is formed. The push button 19 can elastically be deformed on the fulcrum of the portion coupled to the upper plate 18*a*. Two operating protrusion pieces $19_1$ and $19_2$ are formed on the backside of the push button 19. The protrusion pieces $19_1$ and $19_2$ abut on the lock arm 16 to depress the lock arm 16 downward. Two protrusions $18_1$ and $18_2$ which fix the springs 22 (see FIG. 2) are formed on the backside of the upper plate 18*a*. In the outer peripheral walls 18*b* to 18*e*, a recess 18*b*' fitted with the projection portion 4 of the housing 2 is formed in the wall surface 18*b*, and a semi-circular groove 18*d*' forming an electric wire insertion port is formed in the wall surface 18*d* which faces the wall surface 18*b*.

As shown in FIG. 8, the base case 20 includes a bottom plate 20*a*, outer peripheral walls 20*b* to 20*e*, and an opening $20_0$ which is located in the lower portion. The base case 20 is formed by the box-shaped container having the size in which a substantially lower-half of the housing 2 can be accommodated. The base case 20 is made of an insulating synthetic resin. In the outer peripheral walls 20*b* to 20*e*, a recess 20*b*' fitted with the projection portion 4 of the housing 2 is formed in the wall surface 20*b*, and a semi-circular groove 20*c*' forming an electric wire insertion port is formed in the wall surface 20*c* which faces the wall surface 20*b*.

The plug terminal, the housing, and the cover body, which are configured in the above manner, are assembled in the following procedure. The assembling procedure will be described with reference to FIG. 2.

First, the gate member 10 is inserted from the lower portion of the accommodation hole 6 of the housing 2, i.e. from the side of the lower wall surface 3*d* of the housing 2. At this point, the respective arm pieces $\mathbf{11}_1$ and $\mathbf{11}_2$ of the gate member 10 are inserted from the respective guide grooves $\mathbf{3}_1$ and $\mathbf{3}_2$ of the front wall surface 3*a* of the housing 2 to push up the accommodation hole 6. The upper end portions of the arm pieces $\mathbf{11}_1$ and $\mathbf{11}_2$ are inserted into the guide grooves 53 and 54 of the projection portion 4 by pushing up the accommodation hole 6 respectively (see FIG. 3C).

Then, the plural plug terminals 15 and two lock arms 16 are fitted in the housing 2 in which the gate member 10 is fitted. In fitting the plug terminal 15, the guide grooves $\mathbf{13}_1$ to $\mathbf{13}_n$ of the gate member 10 run through the projection-portion holes $\mathbf{4}_1$ to $\mathbf{4}_n$ of the rear wall surface 3*b* (see FIG. 3B) of the housing 2, and the plug terminal 15 is pushed in until the contact portion $\mathbf{15}_1$ located at the front end of the plug terminal 15 is positioned in the projection portion 4. At this point, the two types of plug terminals 15A and 15B are alternately plugged such that the plug terminal 15B is located adjacent to the plug terminal 15A. The fixing portions $\mathbf{15}_2$ of the inserted plug terminals 15 are fixed by press-contact in the housing 2. The two lock arms 16 are inserted into the fitting holes $\mathbf{5}_1$ and $\mathbf{5}_2$ of the rear wall surface 3*b* of the housing 2 in the same manner. The insertion of the lock arms 16 project the locking protrusions 16*b* of the lock arms 16 from the fitting holes $\mathbf{5}_1$ and $\mathbf{5}_2$ of the projection portion 4 respectively while fixing the fixing portions 16*c* into the housing 2.

The housing 2 in which the plural plug terminals 15 and the lock arms 16 are fitted are accommodated in the base case 20, the springs 22 are fitted in the protrusions $\mathbf{14}_1$ and $\mathbf{14}_2$ of the gate member 10 respectively, and the housing 2 is covered with the lid covers 18 to fix the housing 2. When the housing 2 is accommodated in the base case 20 and covered with the lid cover 18, the projection portion 4 of the housing 2 is projected from a gap formed between the recess 20*b*' of the base case 20 and the recess 20*b*' of the lid cover 18, and the electric wire insertion hole 21 is formed in a gap formed between the groove 20*c*' of the base case 20 and the groove 18*d*' of the lid cover 18 to complete the electric connector 1. Thus, when the cover body 17 is formed while separated from the housing 2, the assembly can easily be performed.

Figure 9:
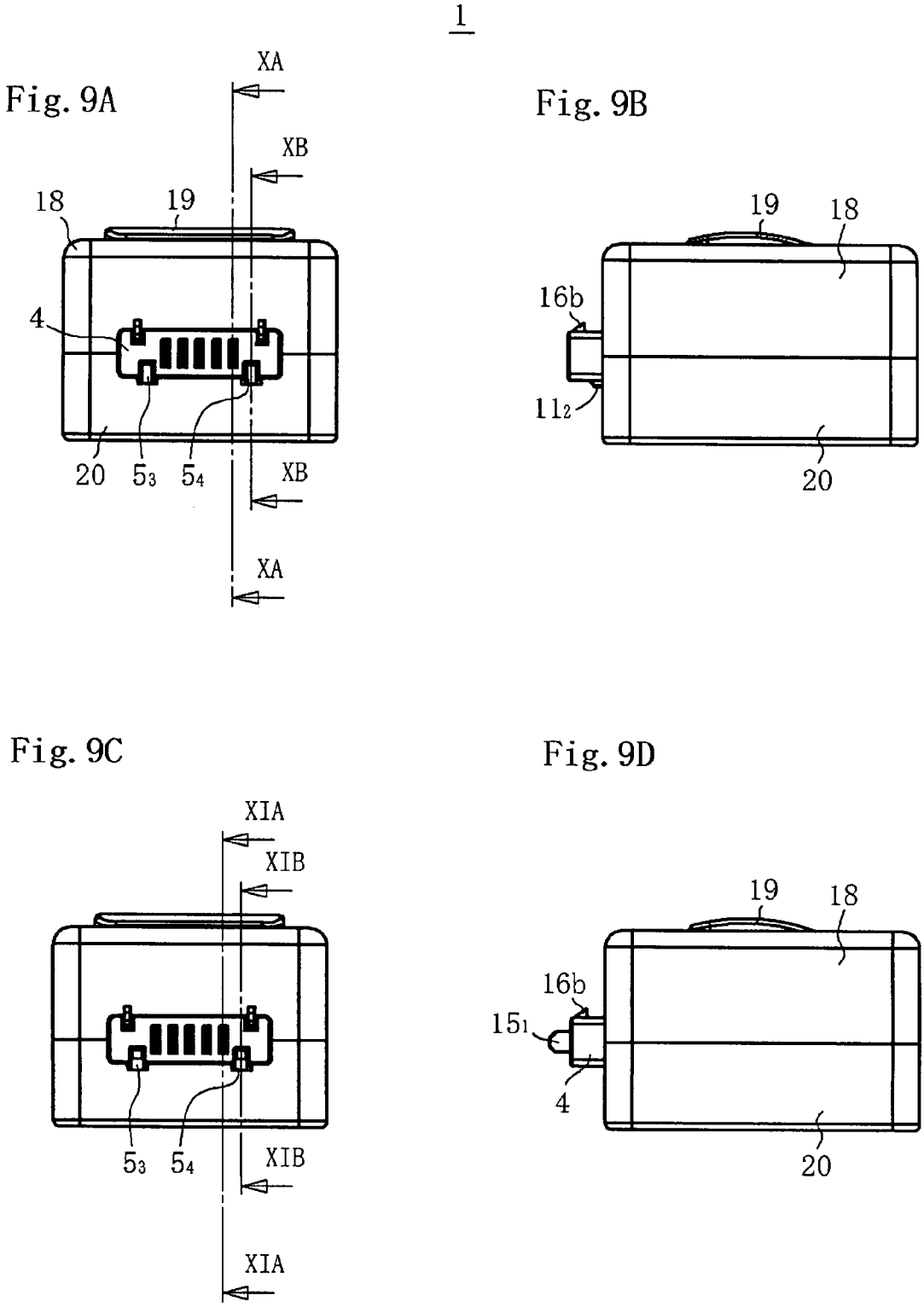
FIG. 9 shows an assembled electric connector.
Figure 12:
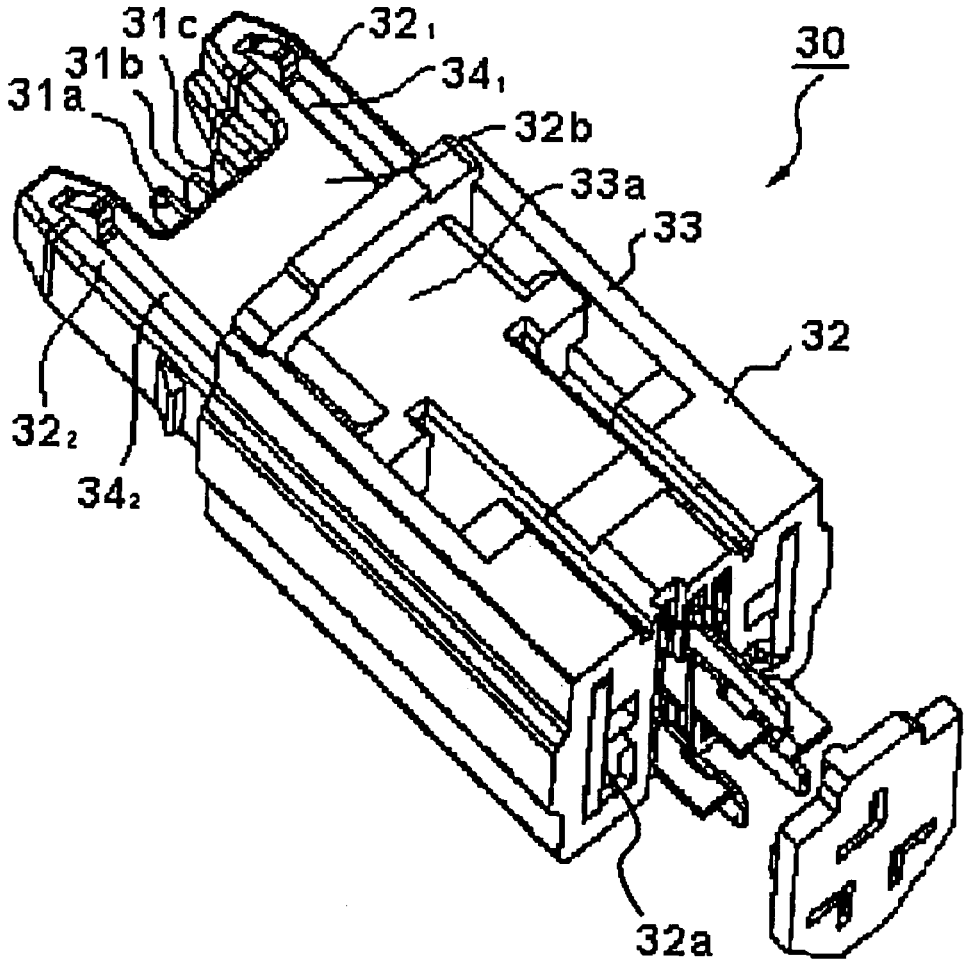
FIG. 12 is a perspective view showing a conventional electric connector.
Figure 13:
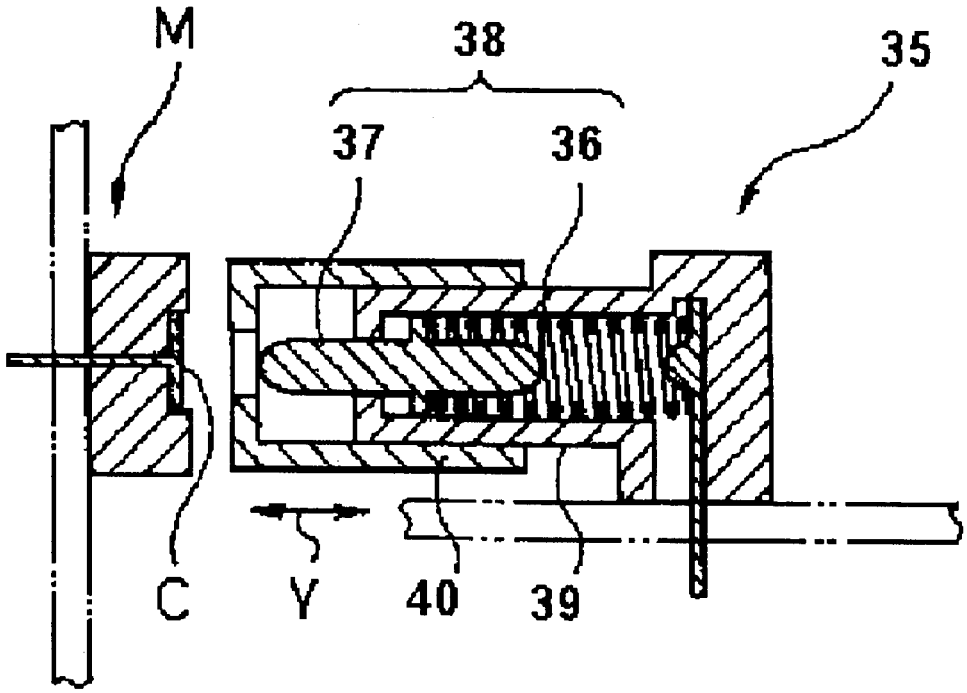
FIG. 13 is a sectional view showing a conventional electric connector.

Then, a method of using the assembled electric connector will be described with reference to FIGS. 9 to 11. FIG. 9 shows the assembled electric connector, FIG. 9A is a front view showing the electric connector in a state in which a contact portion of the plug terminal is pushed in a housing, FIG. 9B is a side view showing the electric connector of FIG. 9A, FIG. 9C is a front view showing the electric connector in a state in which the contact portion of the plug terminal is protruded from the housing, and FIG. 9D is a side view showing the electric connector of FIG. 9C. FIG. 10 shows each section of the electric connector shown in FIG. 9, FIG. 10A is a sectional view taken on line XA-XA of FIG. 9A, FIG. 10B is a sectional view taken on line XB-XB of FIG. 9A, and FIG. 10C is an enlarged sectional view of an XC portion of FIG. 10A. FIG. 11 shows each section of the electric connector of FIG. 9, FIG. 11A is a sectional view taken on line XIA-XIA of FIG. 9C, FIG. 11B is a sectional view taken on line XIB-XIB of FIG. 9C, and FIG. 11C is an enlarged sectional view of an XIC portion of FIG. 11A.

Before the electric connector 1 is coupled to the mating connector (not shown), in the plural plug terminals 15, the spring portion 15*b* is compressed, i.e., the contact portion $\mathbf{15}_1$ of the plug terminal 15 is pushed in onto the side of the fixing portion $\mathbf{15}_2$. At this point, the contact portion $\mathbf{15}_1$ of the plug terminal 15 is accommodated in the housing 2, and the contact portion $\mathbf{15}_1$ is not projected from the front wall surface 4*a* of the projection portion 4. This is because that the gate member 10 located in the accommodation hole 6 of the housing 2 is pushed downward by extension force of the spring 22 and thereby the inclined portion $\mathbf{13}_0$ of the guide groove $\mathbf{13}_1$ is locked to regulate the extension in the longitudinal direction of the plug terminal 15 by the locking protrusion 15*a* of the plug terminal 15.

On the contrary, in coupling the electric connector 1 to the mating connector, the operating piece (not shown) provided in the mating connector intrudes into the respective guide grooves $\mathbf{5}_3$ and $\mathbf{5}_4$ of the projection portion 4 of the housing 2 to push up the respective arm pieces $\mathbf{11}_1$ and $\mathbf{11}_2$ of the gate member 10 against the extension force of the spring 22. When the gate member 10 is pushed upward, because the locking between the locking protrusion 15*a* of each plug terminal 15 and each inclined portion $\mathbf{13}_0$ of the gate member 10 is released, each contact portion $\mathbf{15}_1$ is projected from the front wall surface 4*a* of the projection portion 4 by elastic force of the compressed spring portion 15*b* of each plug terminal 15, which allows each contact portion $\mathbf{15}_1$ to be electrically connected to the terminal of the mating connector. In coupling the electric connector 1 to the mating connector, the locking protrusions 16*b* of the lock arms 16 and 16 are engaged with engaging portions (not shown) of the mating connector to lock the coupling. In releasing the electric connector from the mating connector, the operating protrusion pieces $\mathbf{19}_1$ and $\mathbf{19}_2$ push down the coupling portions 16*a* of the lock arms 16 to operate the locking protrusions 16*b* by pressing downward the push button 19 provided in the lid cover 18, and thereby the lock with the mating connector is released and the electric connector 1 is separated from the mating connector by drawing out the electric connector 1.

In the first embodiment, the contact portion of each plug terminal 15 is pushed in the projection portion when the electric connector 1 is not coupled to the mating connector. Alternatively, the push button 19 is depressed in the state shown in FIG. 11A, the spring portion 15*b* of each plug terminal 15 is compressed in conjunction with the lowering of the gate member 10, and each contact portion $\mathbf{15}_1$ may be pushed in the projection portion 4.

What is claimed is:

1. An electric connector which includes a plug terminal and a connector housing, the plug terminal having a contact portion in one end and an electric wire connecting portion in the other end, the connector housing accommodating the plug terminal, wherein, in said plug terminal, said contact portion and said electric wire connecting portion are connected to each other through an elastic spring, said connector housing accommodates both the plug terminal and a gate member which holds a contact portion of the plug terminal, the contact portion of said plug terminal is held in said connector housing by said gate member while said spring is compressed and pushed in, and said hold state is released to project the contact portion of said plug terminal from said connector housing in coupling the electric connector to the mating connector, wherein the spring of said plug terminal is formed by connecting a plurality of laterally-facing S-shaped spring units in the same plane, and the laterally-facing S-shaped spring units are elastically expanded and contracted in a longitudinal axis direction of said plug terminal, wherein said contact portion is formed in one end portion of the spring including said coupled laterally-facing S-shaped spring units such that said contact portion is projected toward the longitudinal axis direction of said plug terminal, a fixing portion is formed in the other end portion in order to fix the spring to said connector housing, and said electric wire connecting portion is formed in the fixing portion, and wherein said plug terminal includes two types of first and second plug terminals, electric wire connecting portions of said first and second plug terminals are formed at positions where said fixing portions differ from each other, and the first and second plug terminals are alternately fitted in said connector housing.

2. An electric connector according to claim 1, wherein said connector housing accommodates a lock member which locks the coupling between the electric connector and the mating connector.

3. An electric connector according to claim 1, wherein said connector housing accommodates the spring which biases said gate member, and said connector housing is covered with a cover body.

4. An electric connector according to claim 3, wherein operating means is provided in said cover body, and said lock member is operated to release a lock on the mating connector by the operating means.

5. An electric connector which includes a plug terminal and a connector housing, the plug terminal having a contact portion in one end and an electric wire connecting portion in the other end, the connector housing accommodating the plug terminal, wherein, in said plug terminal, said contact portion and said electric wire connecting portion are connected to each other through an elastic spring, said connector housing accommodates both the plug terminal and a gate member which holds a contact portion of the plug terminal, the contact portion of said plug terminal is held in said connector housing by said gate member while said spring is compressed and pushed in, and said hold state is released to project the contact portion of said plug terminal from said connector housing in coupling the electric connector to the mating connector, and wherein said gate member includes holding means and an operating member, the holding means accommodating and holding at least a part of the contact portion of said plug terminal, the operating member releasing the hold of said contact portion by said holding means in coupling the electric connector to the mating connector, and said gate member is movably accommodated in said connector housing.

6. An electric connector according to claim 5, wherein said connector housing accommodates a lock member which locks the coupling between the electric connector and the mating connector.

7. An electric connector according to claim 5, wherein said connector housing accommodates the spring which biases said gate member, and said connector housing is covered with a cover body.

8. An electric connector according to claim 7, wherein operating means is provided in said cover body, and said lock member is operated to release a lock on the mating connector by the operating means.

9. An electric connector which includes a plug terminal and a connector housing, the plug terminal having a contact portion in one end and an electric wire connecting portion in the other end, the connector housing accommodating the plug terminal, wherein, in said plug terminal, said contact portion and said electric wire connecting portion are connected to each other through an elastic spring, said connector housing accommodates both the plug terminal and a gate member which holds a contact portion of the plug terminal, the contact portion of said plug terminal is held in said connector housing by said gate member while said spring is compressed and pushed in, and said hold state is released to project the contact portion of said plug terminal from said connector housing in coupling the electric connector to the mating connector, and wherein, in said connector housing, a projection portion projected forward from a coupling face between the electric connector and the mating connector is formed, and an operating member is inserted into a groove provided in the projection portion, the operating member moving the contact portion of said plug terminal and said gate member.

10. An electric connector according to claim 9, wherein said connector housing accommodates a lock member which locks the coupling between the electric connector and the mating connector.

11. An electric connector according to claim 9, wherein said connector housing accommodates the spring which biases said gate member, and said connector housing is covered with a cover body.

12. An electric connector according to claim 11, wherein operating means is provided in said cover body, and said lock member is operated to release a lock on the mating connector by the operating means.

* * * * *